US006755475B1

(12) United States Patent
Tiesler et al.

(10) Patent No.: US 6,755,475 B1
(45) Date of Patent: Jun. 29, 2004

(54) MULTIPLE INDENTATION LOAD DEFLECTION FOAM MOLDING

(75) Inventors: John M. Tiesler, Harrison Township, MI (US); Bari W. Brown, Ann Arbor, MI (US); George B Byma, Clarkston, MI (US)

(73) Assignee: Lear Corporation, Southfield, MI (US)

( * ) Notice: Subject to any disclaimer, the term of this patent is extended or adjusted under 35 U.S.C. 154(b) by 27 days.

(21) Appl. No.: 10/250,094

(22) Filed: Jun. 3, 2003

(51) Int. Cl.[7] ..... A47C 7/02

(52) U.S. Cl. ..... 297/452.26; 297/452.27; 297/DIG. 1

(58) Field of Search ..... 297/452.26, 452.27, 297/DIG. 1

(56) References Cited

U.S. PATENT DOCUMENTS

| | | | | | |
|---|---|---|---|---|---|
| 3,718,417 | A | | 2/1973 | Bethe | 425/406 |
| 3,918,863 | A | | 11/1975 | Rhodes, Jr. | 425/117 |
| 4,405,681 | A | | 9/1983 | McEvoy | 428/309.9 |
| 4,718,153 | A | | 1/1988 | Armitage et al. | 29/91.1 |
| 4,738,809 | A | | 4/1988 | Storch | 264/46.6 |
| 4,753,480 | A | * | 6/1988 | Morell | 297/452.27 X |
| 4,755,411 | A | | 7/1988 | Wing et al. | 428/71 |
| 4,819,288 | A | * | 4/1989 | Lowthian | 297/DIG. 1 |
| 5,142,757 | A | | 9/1992 | Thary | 29/91.1 |
| 5,544,942 | A | | 8/1996 | Vu Khac et al. | 297/452.37 |
| 6,447,058 | B1 | | 9/2002 | Jackson | 297/216.13 |
| 6,457,777 | B1 | * | 10/2002 | Kazuno et al. | 297/DIG. 1 |
| 6,571,411 | B1 | * | 6/2003 | Ebe | 297/452.27 |
| 6,601,253 | B1 | * | 8/2003 | Tarquinio | 5/739 |

* cited by examiner

*Primary Examiner*—Anthony D. Barfield
(74) *Attorney, Agent, or Firm*—Bill C. Panagos

(57) ABSTRACT

A cushion structure having multiple indentation load deflection areas created by using inflatable preformed containers within a base cushion foam and method for making same. The invention can be utilized to make cushions for use with separately manufactured upholstery covers as well as for pour-in-place or foam-in-cover upholstered cushions. Such cushions are suitable for use in commercial and residential furniture as well as automobiles, buses, trains and aircraft.

15 Claims, 2 Drawing Sheets

MULTIPLE INDENTATION LOAD DEFLECTION FOAM MOLDING

BACKGROUND OF INVENTION

1. Field of the Invention

The present invention generally relates to a cushion article. More particularly, the invention relates to a structure and method for preparing a multiple indentation load deflection (ILD) cushion article utilizing an inflatable partitioning means.

2. Description of the Related Art

Well established methods of manufacturing upholstered cushion articles utilizing both separately manufactured cushions with separately mounted coverings as well as pour-in-place or foam-in-cover have been developed. Likewise, there are established methods of creating differing foam densities and compressibilities. However, this approach of preparing different density cushion articles requires a relatively large number of individualized process steps which causes the cost of production to be quite high. In another approach, different density cushion articles are prepared independently, and the articles are bonded or glued together. Again, however, a relatively large number of steps are required to achieve a finished multiple ILD cushion article, and consequently the manufacturing cost is relatively high. In order to reduce the number of production steps, equipment has been developed which deposits different density foam at different locations, thus providing a multiple ILD cushion article in one step. Unfortunately, this technique does not produce a well defined boundary between the different density regions.

For example, U.S. Pat. No. 3,718,417 issued Feb. 27, 1973 to Bethe teaches the use of mechanical compression of desired areas of curing foam in a mold to create areas of higher foam density than non-compressed areas within the mold.

U.S. Pat. No. 3,918,863 issued Nov. 11, 1975 to Rhodes, Jr. teaches a method of creating dual density foam articles using a rigid mold partition insert during the molding process allowing the introduction of different density foams substantially simultaneously during the molding process.

U.S. Pat. No. 4,405,681 issued Sep. 20, 1983 to McEvoy teaches a method of pouring three different density foam materials into the same mold in sequential manner forming a seat cushion having differing foam densities in different areas of the cushion.

U.S. Pat. No. 4,718,153 issued Jan. 12, 1988 to Armitage et al teaches method of adhesively laminating fabric and foam together and shaping the so laminated combination.

U.S. Pat. No. 4,738,809 issued Apr. 19, 1988 to Storch teaches a method of providing a covered foam cushion element with a hollow core to reduce cushion element weight.

U.S. Pat. No. 4,755,411 issued Jul. 5, 1988 to Wing et al teaches a use of a flexible membrane to hold and cover a multi-density foam core.

U.S. Pat. No. 5,142,757 issued Sep. 1, 1992 to Thary teaches creating a multi-density foam seat cushion using a foaming of one density foam around an already foamed core and using a mechanical means to form to shape.

U.S. Pat. No. 5,544,942 issued Aug. 13, 1996 to Vu Khac et al teaches a multi-density foam seat back cushion formed by inserting one preformed foam piece into/onto another preformed foam piece.

U.S. Pat. No. 6,447,058 issued Sep. 10, 2002 to Jackson teaches a seat cushion for protecting a users spinal column by inserting a gel or foam of low density into a cavity in a higher density foam perform.

DISCLOSURE OF THE INVENTION

The present invention provides advantages and alternatives over the prior art by providing an improved structure and method of manufacture for upholstered cushion articles.

According to a further aspect of the present invention is to provide a multiple indentation load deflection (ILD) cushion structure having well defined density boundaries.

According to yet another aspect of the present invention is to provide a multiple ILD cushion structure method of manufacture that allows the different ILD foams to be introduced substantially simultaneously with the base cushion foam, before the introduction of the base cushion foam, or after the introduction of the base cushion foam.

According to a yet further aspect of the present invention there is provided a seat cushions structure for an upholstered seat comprising: an upholstered foam seat bottom cushion having a base foam within which is located at least one area of foam of a different ILD than said base foam, said at least one area of foam being defined by a preformed inflatable container, and an upholstered foam seat back cushion having a base foam within which is located at least one area of foam of a different ILD than said base foam, said at least one area being defined by a preformed inflatable container, thereby forming a seat cushion structure having at least two distinctly defined areas of foam having different ILDS.

According to still another aspect of the present invention there is provided a seat cushions structure for an automotive upholstered seat comprising: an upholstered foam seat bottom cushion having a base foam within which is located at least one area of foam of a different ILD than said base foam, said at least one area of foam being defined by a preformed inflatable container, an upholstered foam seat back cushion having a base foam within which is located at least one area of foam of a different ILD than said base foam, said at least one area being defined by a preformed inflatable container, and an upholstered foam seat head restraint having a base foam within which is located at least one area of foam of a different ILD than said base foam, thereby forming a seat cushion structure having at least two distinctly defined areas of foam having different ILDs.

According to still yet another aspect of the present invention there is provided a process for forming an upholstered seat cushion having multiple ILD foam comprising at least two different ILD foam areas, said at least two areas defined by an inflatable preformed container comprising: mounting the upholstery cover material in a first mold half, positioning at least one preformed inflatable container in said first mold half, mounting the second half of said mold onto said first half of said mold; attaching an inflation means to said at least one preformed inflatable container; inflating said at least one preformed inflatable container to a desired level using a suitable inflation fluid; introducing a foam having a first desired ILD into said mold using a foam introduction and molding means: foaming said foam to substantially surround said at least one preformed inflatable container and permanently adhere said at least one preformed inflatable container to said foam; introducing a foam having a second desired ILD different from that of the foam into said at least one preformed inflatable container using a foam introduction means and a releasing said suitable inflation fluid; foaming said foam to substantially fill said at least one preformed inflatable container and permanently adhere said foam to said at least one preformed inflatable container, and separating said mold halves and removing the upholstered multiple ILD foam cushion.

According to a still yet further aspect of the present invention there is provided a process for forming an upholstered seat cushion having multiple ILD foam comprising at least two different ILD foam areas, said at least two areas defined by an inflatable preformed container comprising: mounting the upholstery cover material in a first mold half, positioning at least one preformed inflatable container in said first mold half, mounting the second half of said mold onto said first half of said mold; introducing a foam having a first desired ILD into said at least one preformed inflatable container using a foam introduction and molding means; foaming said foam to substantially inflate said at least one preformed inflatable container and permanently adhere said at least one preformed inflatable container to said foam; introducing a foam having a second desired ILD different from that of the foam into said mold using a foam introduction means and molding means; foaming said foam to substantially fill said mold around said foam filled at least one preformed inflatable container, and separating said mold halves and removing the upholstered multiple ILD foam cushion.

According to yet another aspect of the present invention there is provided a process for forming an upholstered seat cushion having multiple ILD foam comprising at least two different ILD foam areas, said at least two areas defined by an inflatable preformed container comprising: mounting the upholstery cover material in a first mold half, positioning at least one preformed inflatable container in said first mold half, mounting the second half of said mold onto said first half of said mold; introducing a foam having a first desired ILD into said mold using a foam introduction and molding means; introducing a foam having a second desired ILD into said at least one preformed inflatable container substantially simultaneously with the introduction of said foam, foaming said foams substantially simultaneously to form at least two areas within said mold having different ILD foams and substantially fill said mold; separating said mold halves and removing the upholstered multiple ILD foam cushion.

The present invention thus advantageously provides a multiple ILD foam upholstered cushion structure for seating and particularly for automotive seating.

DETAILED DESCRIPTION

Figure 1:
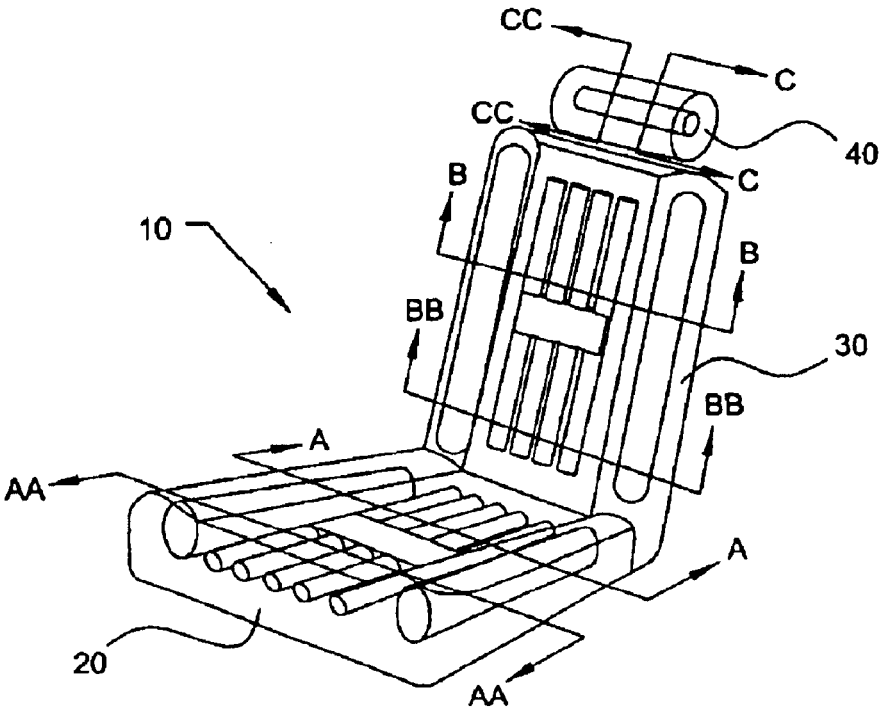
FIG. 1 shows a phantom perspective view of one preferred embodiment of the invention.

Reference will now be made to the drawings, wherein to the extent possible like reference numerals are utilized to designate like components throughout the various views. Referring to FIG. 1, there is presented one preferred embodiment of a seat molding assembly 10 having multiple foam Indentation Load Deflection (ILD) areas therein, defining a seat cushion 20, a seat back (30) and a seat head restraint (40).

Figure 2:
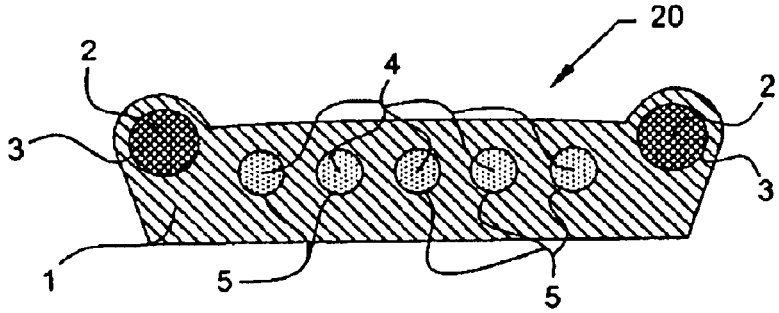
FIG. 2 shows a section plan view through line A A of FIG. 1 of the present invention.

Referring now to FIG. 2, there is shown a section plan view through line AA of FIG. 1 of one preferred embodiment of an automotive foam seat bottom cushion molding 20 of the present invention having a first desired ILD foam 1 having disposed therein a higher ILD foam 2 having a form determined by preformed inflatable foam containers 3 located so as to provide cushion edge support, and another desired ILD foam 4 having a form determined by preformed inflatable foam containers 5 located so as to provide greater occupant seating comfort.

Figure 3:
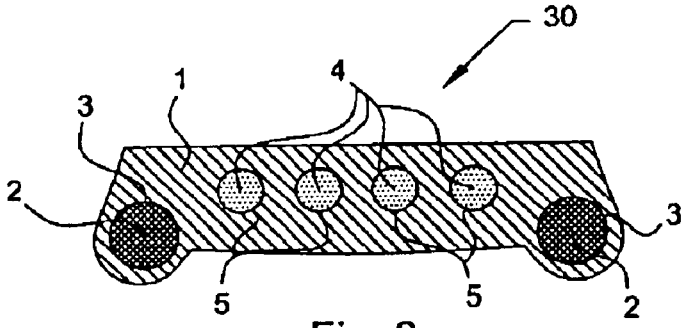
FIG. 3 shows a section plan view through line B B of FIG. 1 of the present invention.

Turning now to FIG. 3, a section plan view through line BB of FIG. 1 of one preferred embodiment of an automotive foam seat back cushion molding 30 of the present invention having a first desired ILD foam 1 having disposed therein a higher ILD foam 2 having a form determined by preformed inflatable foam containers 3 located so as to provide seat back edge support, and another desired ILD foam 4 having a form determined by preformed inflatable foam container 5 located so as to provide greater occupant back comfort.

Figure 4:
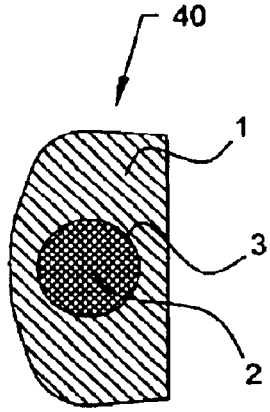
FIG. 4 shows a section plan view through line C C of FIG. 1 of the present invention.

FIG. 4 shows the section plan view through line CC of FIG. 1 of one preferred embodiment of an automotive foam seat head restraint cushion molding 40 of the present invention having a first desired ILD foam 1 having disposed therein a higher ILD foam 2 having a form determined by preformed inflatable foam container 3 located so as to provide a seat head restraint with desired firmness and comfort of the occupant.

Figure 5:
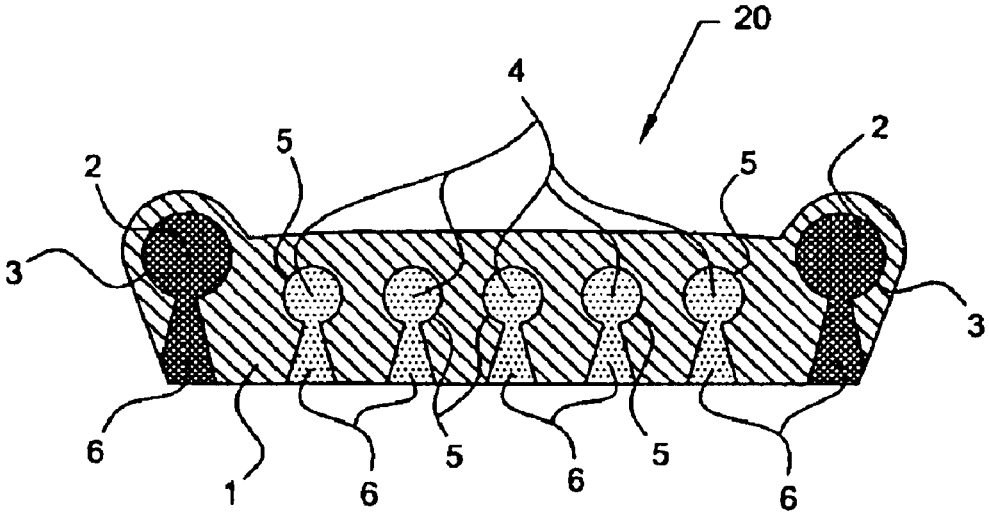
FIG. 5 shows a section plan view through line AAAA of FIG. 1 of the present invention.

In FIG. 5 there is shown a section plan view through line AAAA of FIG. 1 of one preferred embodiment of an automotive foam seat bottom cushion molding 20 of the present invention having a first desired ILD foam 1 having disposed therein a higher ILD foam 2 having a form determined by preformed inflatable foam containers 3 located so as to provide cushion edge support and mold inflatable foam container locating pin holes 6 that are preferably also used to introduce the higher ILD foam 2 into preformed inflatable foam containers 3 and are themselves filled with said higher ILD foam 2 upon withdrawal of said locating pins (not shown), and another desired ILD foam 4 having a form determined by preformed inflatable foam containers 5 located so as to provide greater occupant seating comfort and having mold inflatable foam container locating pin holes 6 that are preferably also used to introduce the higher ILD foam 2 into preformed inflatable foam containers 3 and are themselves filled with said higher ILD foam 2 upon withdrawal of said locating pins (not shown).

Figure 6:
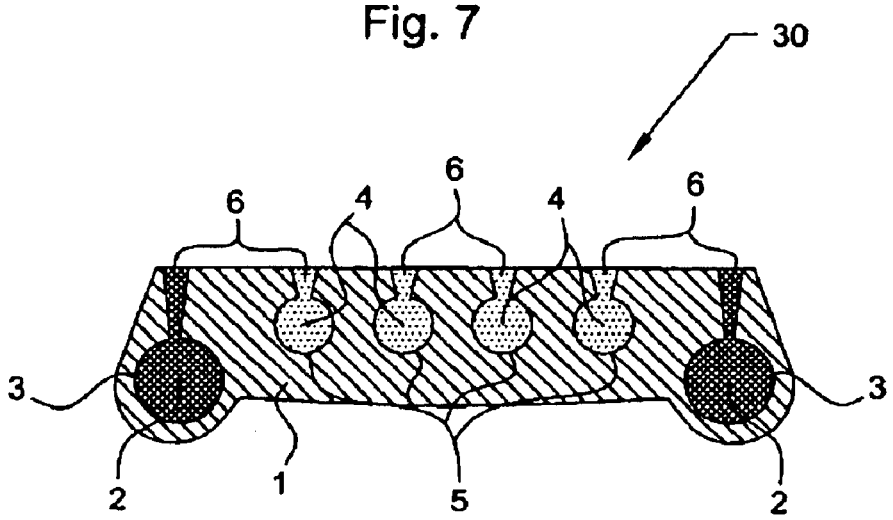
FIG. 6 shows a section plan view through line BBBB of FIG. 1 of the present invention.

Turning to FIG. 6 there is shown a section view through line BBBB of FIG. 1 of one preferred embodiment of an automotive foam seat back cushion molding 30 of the present invention having a first desired ILD foam 1 and having disposed therein a higher ILD foam 2 having a form determined by preformed inflatable foam containers 3 located so as to provide seat back edge support and mold inflatable foam container locating pin holes 6 that are preferably also used as locations to introduce the higher ILD foam 2 into preformed inflatable foam containers 3 and are themselves filled with said higher ILD foam 2 upon withdrawal of said locating pins (not shown), and another desired ILD foam 4 having a form determined by preformed inflatable foam container 5 located so as to provide greater occupant back comfort and mold inflatable foam container locating pin holes 6 that are preferably also used as locations to introduce the higher ILD foam 2 into preformed inflatable foam containers 3 and are themselves filled with said higher ILD foam 2 upon withdrawal of said locating pins (not shown).

Figure 7:
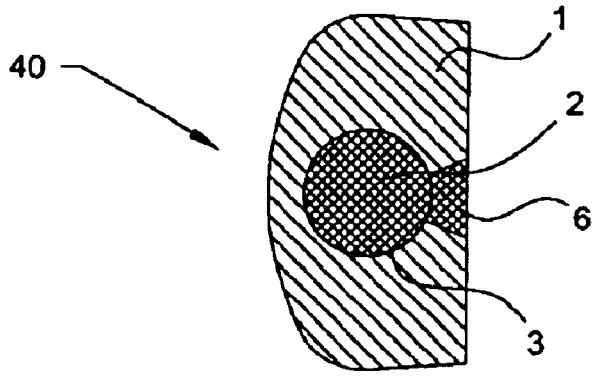
FIG. 7 shows a section plan view through line CCCC of FIG. 1 of the present invention.

Referring to FIG. 7 there is shown a section view through line CCCC of FIG. 1 of one preferred embodiment of an automotive foam seat head restraint cushion molding 40 of the present invention having a first desired ILD foam 1 having disposed therein a higher ILD foam 2 having a form determined by preformed inflatable foam container 3 located so as to provide a seat head restraint with desired firmness and comfort of the occupant and mold inflatable foam container locating pin holes 6 that are preferably also used as locations to introduce the higher ILD foam 2 into preformed inflatable foam containers 3 and are themselves filled with said higher ILD foam 2 upon withdrawal of said locating pins (not shown).

The mold locating pins are utilized to locate and hold in position during manufacturing the preformed inflatable foam containers. It is to be further understood that the preformed inflatable foam containers may be constructed of two sheets of material that are formed having a salvage material area at the seam such that the mold locating pin holes 6 may be located in the salvage area and not pass directly into the preformed inflatable foam container. In this case, other means for filling preformed inflatable containers are required, preferably the fluid fill mechanism.(not shown).

Suitable materials for making the inflatable preformed foam containers include, for example, any suitable thermoplastic film material and particularly polypropylene, polyethylene, and polyurethane film materials. The presently preferred material composition of the inflatable preformed foam containers is polypropylene.

In practice at least one un-inflated preformed inflatable foam container 3 is placed in a desired position within an appropriate mold. It is preferred to provide a means of holding the inflated preformed inflatable foam container 3 in place during the molding of the base cushion foam 1. This may be accomplished by the design of the mold cavities, by the use of pressure sensitive adhesives (psa's), or most preferably by the use of locating pins within the mold to physically hold the at least one preformed inflatable foam container in position. The second piece of the mold is mounted and secured to the first piece of the mold. An inflation means is attached to each such uninflated preformed inflatable foam container 3 positioned in the mold and an inflation fluid is introduced into the preformed foam container 3 until it has been inflated to the desired level. Appropriate foam is introduced into the mold and the foam is allowed to foam to fill the mold and seal the inflated preformed container 3 in place within the cushion base foam 1. After foaming the base cushion foam, the original inflating fluid is allowed to bleed out of the foam container 3. Then a foam of a different ILD is introduced into the inflated depressurized foam container 3 and said foam of a different ILD is allowed to foam and. After all foam has been introduced and cured the mold is opened and the resulting assembly of the present invention 10 is removed and trimmed as necessary for use as a seat cushion in an automotive vehicle. The molds and foams, especially foaming polyurethanes, suitable for use in the present invention are well known in the art. The presently preferred foam is polyurethane foam.

In another preferred embodiment of the present invention all of the base cushion foam and the foams used in the at least one inflatable preformed container 3 are introduced substantially simultaneously and allowed to foam and inflate the preformed container 3 as well as the rest of the mold area concurrently.

In yet another preferred embodiment of the present invention the at least one inflatable preformed containers have foam introduced into them and allowed to foam before the base cushion foam is introduced and foamed within the mold. In this embodiment it is understood that the different ILD foam is used as the inflating fluid within the inflatable preformed containers.

It is to be understood that while the preferred embodiments disclosed herein refer to automotive seats the present invention may be utilized for the production of multiple ILD foam cushion structures for any upholstered seating, including, but not limited to commercial, industrial and residential furniture as well as automobile, aircraft, train and bus seating.

It is to be further understood that various combinations of foam introduction and foaming may be combined as desired to form seat cushion structures that have a set of desired foam density profiles. These may include, for example, open or closed mold foaming processes as are well known in the art.

Although the preferred embodiments of the present invention have been disclosed, various changes and modifications may be made without departing from the scope of the invention as set forth in the appended claim.

What is claimed is:

1. A multiple indentation load deflection foam cushion structure for an upholstered seat comprising:

an upholstered foam cushion having a base foam with a first desired indentation load deflection within which is located at least one area of molded in place foam having a second desired indentation load deflection, the shape of said at least one area of foam being defined by a preformed inflatable container.

2. A multiple indentation load deflection foam cushion structure as claimed in claim 1 wherein, said structure is suitable as a seat bottom cushion having an area of molded in place foam of a higher indentation load deflection along each side of the base foam, said areas of higher indentation load deflection being defined by preformed inflatable containers.

3. A multiple indentation load deflection foam cushion structure as claimed in claim 2 wherein, said structure is suitable as a seat bottom cushion having at least one area of molded in place foam having a lower indentation load deflection than base foam and located in the center portion of said seat cushion structure, said at least one area of lower indentation load deflection being defined by preformed inflatable containers.

4. A multiple indentation load deflection foam cushion structure as claimed in claim 1 wherein, said at least one preformed inflatable container comprises a thermoplastic film.

5. The thermoplastic film as claimed in claim 4 wherein, said thermoplastic film is selected from the group comprising polypropylene, polyethylene, and polyurethane film materials, preferably polypropylene film material.

6. A multiple indentation load deflection foam cushion structure as claimed in claim 1 wherein, said structure is suitable as a seat back cushion having an area of molded in place foam of a higher indentation load deflection along each side of the base foam, said areas of higher indentation load deflection being defined by preformed inflatable containers.

7. A multiple indentation load deflection foam cushion structure as claimed in claim 6 wherein, said structure is suitable as a seat back cushion having at least one area of molded in place foam having a lower indentation load deflection than base foam and located in the center portion of said seat cushion structure, said at least one area of lower indentation load deflection being defined by preformed inflatable containers.

8. A multiple indentation load deflection foam cushion structure as claimed in claim 6 wherein, said at least one preformed inflatable container comprises a thermoplastic film.

9. The thermoplastic film as claimed in claim 8 wherein, said thermoplastic film is selected from the group comprising polypropylene, polyethylene, and polyurethane film materials.

10. A multiple indentation load deflection foam structure suitable for use as an automobile, bus, aircraft, and train upholstered seat comprising:

a) a seat bottom cushion structure comprising a foam cushion having a base foam with a first desired indentation load deflection within which is located at least one area of foam having a second desired indentation load deflection, the shape of said at least one area of foam being defined by a preformed inflatable container, and b) a seat back cushion structure comprising a foam cushion having a base foam with a first desired indentation load deflection within which is located at least one area of foam having a second desired indentation load deflection, the shape of said at least one area of foam being defined by a preformed inflatable container.

11. A multiple indentation load deflection foam cushion structure suitable for use as an automobile, bus, aircraft, and train upholstered seat as claimed in claim 10 wherein, said suitable seat structure is further defined as comprising a seat head restraint foam structure having a first desired indentation load deflection base foam within which is located at least one area of foam having a second desired indentation load deflection, the shape of said at least one area of foam being defined by a preformed inflatable container.

12. A multiple indentation load deflection foam cushion structure suitable for use as an automobile, bus, aircraft, and train upholstered seat as claimed in claim 11 wherein, said at least one preformed inflatable container comprises a thermoplastic film.

13. The thermoplastic film as claimed in claim 12 wherein, said thermoplastic film is selected from the group comprising polypropylene, polyethylene, and polyurethane film materials.

14. A multiple indentation load deflection foam cushion structure suitable for use as an automobile, bus, aircraft, and train upholstered seat as claimed in claim 10 wherein, said at least one preformed inflatable container comprises a thermoplastic film.

15. The thermoplastic film as claimed in claim 14 wherein, said thermoplastic film is selected from the group comprising polypropylene, polyethylene, and polyurethane film materials.

* * * * *